US009109435B2

(12) United States Patent
O'Connor et al.

(10) Patent No.: US 9,109,435 B2
(45) Date of Patent: Aug. 18, 2015

(54) MONOBORE EXPANSION SYSTEM—ANCHORED LINER

(75) Inventors: Keven O'Connor, Houston, TX (US); Joerg Lehr, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 972 days.

(21) Appl. No.: 13/277,959

(22) Filed: Oct. 20, 2011

(65) Prior Publication Data

US 2013/0098634 A1 Apr. 25, 2013

(51) Int. Cl.
*E21B 43/10* (2006.01)

(52) U.S. Cl.
CPC ..... *E21B 43/103* (2013.01); *E21B 43/105* (2013.01)

(58) Field of Classification Search
CPC ..... E21B 43/103; E21B 43/105
See application file for complete search history.

(56) References Cited

U.S. PATENT DOCUMENTS

| | | | |
|---|---|---|---|
| 6,561,227 | B2 | 5/2003 | Cook et al. |
| 6,578,630 | B2 | 6/2003 | Simpson et al. |
| 6,662,876 | B2 | 12/2003 | Lauritzen |
| 6,688,397 | B2 | 2/2004 | McClurkin et al. |
| 6,712,151 | B2 | 3/2004 | Simpson et al. |
| 6,860,329 | B1 | 3/2005 | Oosterling |
| 6,902,000 | B2 | 6/2005 | Simpson et al. |
| 6,976,536 | B2 | 12/2005 | Simpson et al. |
| 7,007,760 | B2 | 3/2006 | Lohbeck et al. |
| 7,011,161 | B2 | 3/2006 | Ring et al. |
| 7,021,390 | B2 | 4/2006 | Cook et al. |
| 7,036,582 | B2 | 5/2006 | Cook et al. |
| 7,044,218 | B2 | 5/2006 | Cook et al. |
| 7,077,211 | B2 | 7/2006 | Cook et al. |
| 7,077,213 | B2 | 7/2006 | Cook et al. |
| 7,086,475 | B2 | 8/2006 | Cook |
| 7,100,685 | B2 | 9/2006 | Cook et al. |
| 7,108,072 | B2 | 9/2006 | Cook et al. |
| 7,117,940 | B2 | 10/2006 | Campo et al. |
| 7,121,337 | B2 | 10/2006 | Cook et al. |
| 7,131,498 | B2 | 11/2006 | Campo et al. |
| 7,195,061 | B2 | 3/2007 | Cook et al. |
| 7,198,100 | B2 | 4/2007 | Cook et al. |
| 7,201,223 | B2 | 4/2007 | Cook et al. |
| 7,204,007 | B2 | 4/2007 | Cook et al. |

(Continued)

OTHER PUBLICATIONS

Filippov, A. et al. "Expandable Tubular Solutions," SPE 565000-MS; SPE Annual Technical Conference and Exhibition, Oct. 3-6, 1999, Houston, Texas; 1999 Society of Petroleum Engineers.

*Primary Examiner* — Jennifer H Gay
*Assistant Examiner* — Caroline Butcher
(74) *Attorney, Agent, or Firm* — Mossman Kumar & Tyler PC

(57) ABSTRACT

Methods for forming a wellbore may include placing an upper section of inside a lower section of a parent liner; positioning an upper sealing member and a lower sealing member in the wellbore to form a pressure chamber, and expanding the second liner using the pressure chamber. The sealing members move axially relative to one another and the second liner has an inner bore that is hydraulically isolated from the pressure chamber. A related apparatus may include upper and lower sealing members that cooperate to form a pressure chamber that is hydraulically isolated from an inner bore of the second liner. A work string may include the sealing members, a connector that extends through the pressure chamber and the second liner; and an expander. The expander expands the second liner in response to the axial separation of the sealing members.

20 Claims, 8 Drawing Sheets

(56) References Cited

U.S. PATENT DOCUMENTS

| | | | | |
|---|---|---|---|---|
| 7,216,701 | B2 | 5/2007 | Cook et al. | |
| 7,231,985 | B2 | 6/2007 | Cook et al. | |
| 7,240,728 | B2 | 7/2007 | Cook et al. | |
| 7,246,667 | B2 | 7/2007 | Cook et al. | |
| 7,255,177 | B2 | 8/2007 | Duggan et al. | |
| 7,275,601 | B2 | 10/2007 | Cook et al. | |
| 7,287,603 | B2 | 10/2007 | Hay et al. | |
| 7,299,881 | B2 | 11/2007 | Cook et al. | |
| 7,306,044 | B2 | 12/2007 | Connell et al. | |
| 7,325,602 | B2 | 2/2008 | Cook et al. | |
| 7,350,563 | B2 | 4/2008 | Waddell et al. | |
| 7,350,564 | B2 | 4/2008 | Cook et al. | |
| 7,357,188 | B1 | 4/2008 | Cook et al. | |
| 7,357,190 | B2 | 4/2008 | Cook et al. | |
| 7,363,690 | B2 | 4/2008 | Cook et al. | |
| 7,367,389 | B2 | 5/2008 | Duggan et al. | |
| 7,383,889 | B2 | 6/2008 | Ring et al. | |
| 7,395,857 | B2 | 7/2008 | Hillis | |
| 7,410,000 | B2 | 8/2008 | Cook et al. | |
| 7,757,774 | B2 | 7/2010 | Ring | |
| 2002/0166668 | A1* | 11/2002 | Metcalfe et al. | 166/378 |
| 2010/0032167 | A1* | 2/2010 | Adam et al. | 166/382 |

* cited by examiner

MONOBORE EXPANSION SYSTEM—ANCHORED LINER

BACKGROUND OF THE DISCLOSURE

1. Field of the Disclosure

This disclosure relates generally to oilfield downhole tools and more particularly to assemblies utilized for completing wellbores.

2. Description of the Related Art

Hydrocarbons, such as oil and gas, as well as geothermal resources are recovered from a subterranean formation using a wellbore drilled into the formation. Such wellbores are typically completed by placing a casing along the wellbore length, cementing the annulus between the casing and the wellbore and perforating the casing adjacent each production zone. A wellbore casing is often made by joining relatively short pipe sections (for example 10 m long) via threaded connections at the pipe ends. Such conventional casing techniques utilize tubular strings of decreasing diameters and include multiple threaded connections. Monobore wellbore construction utilizing a solid casing design has limitations in terms of achievable collapse resistance of an expanded tubular. Expansion of liner elements connected with threads run a risk with respect to the achievable long term reliability. The cost of building deep and extended reach wells is very high. Therefore, it is desirable to provide alternative methods of building such wellbores.

SUMMARY OF THE DISCLOSURE

In aspects, the present disclosure provides a method of forming a wellbore. The method may include placing a first liner having a lower section in the wellbore; placing a second liner in the wellbore, with an upper section of the second liner placed inside the lower section of the first liner; positioning an upper sealing member and a lower sealing member in the wellbore to form a pressure chamber, the upper and lower sealing members being axially movable relative to one another; and expanding the second liner using the pressure chamber, the second liner having an inner bore hydraulically isolated from the pressure chamber.

In aspects, the present disclosure also provides an apparatus for positioning a first liner and a second liner in a wellbore. The second liner may have an upper section placed inside a lower section of the first liner. The apparatus may include at least one lower sealing member cooperating with at least one upper sealing member to form a pressure chamber that is hydraulically isolated from an inner bore of the second liner. The upper sealing member(s) and the lower sealing member (s) axially separate in response to a pressure in the pressure chamber. The apparatus may further include a work string that conveys the sealing members into the wellbore; at least one connector connected to the work string and extending through the pressure chamber and the second liner; and an expander connected to the connector. The expander expands the second liner in response to the axial separation of the sealing members.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
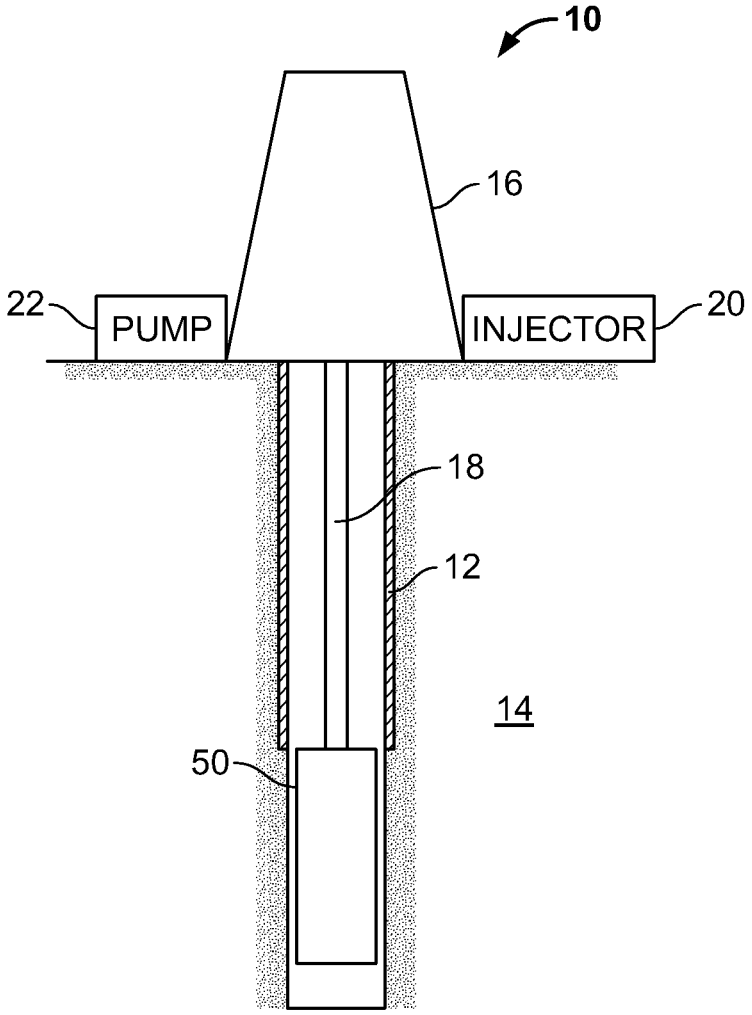
FIG. 1 illustrates a rig for completing a well using a liner system in accordance with one embodiment of the present disclosure.

The present disclosure relates to monobore wellbores using overlapping expandable liners to case the wellbore. The present disclosure is susceptible to embodiments of different forms. There are shown in the drawings, and herein will be described in detail, exemplary embodiments of the present disclosure with the understanding that the present disclosure is to be considered an exemplification of the principles of the disclosure and is not intended to limit the disclosure to that illustrated and described herein.

Referring initially to FIG. 1, there is shown a system 10 for performing a wellbore-related operation such as completing a wellbore 12 drilled in a formation 14. The system 10 includes a rig 16 at the surface for deploying a work string 18. The work string 18 may convey a liner completion system 50 for lining the wellbore 12 with wellbore tubulars. The tubulars may be a liner, casing, coiled tubing, rigid tubulars, or other tubulars that are configured to be expanded and fixed in the wellbore 12. The wellbore 12 may be for recovering, hydrocarbons, such as oil and gas, as well as for accessing geothermal resources. The rig 16 may include devices such as an injector 20 to convey the work string 18 into and out of the wellbore 12 and a pump 22. It should be understood that the injector 20 and pump 22 are merely illustrative of the types of equipment that may be used in connection with wellbore operations described below.

Figure 2:
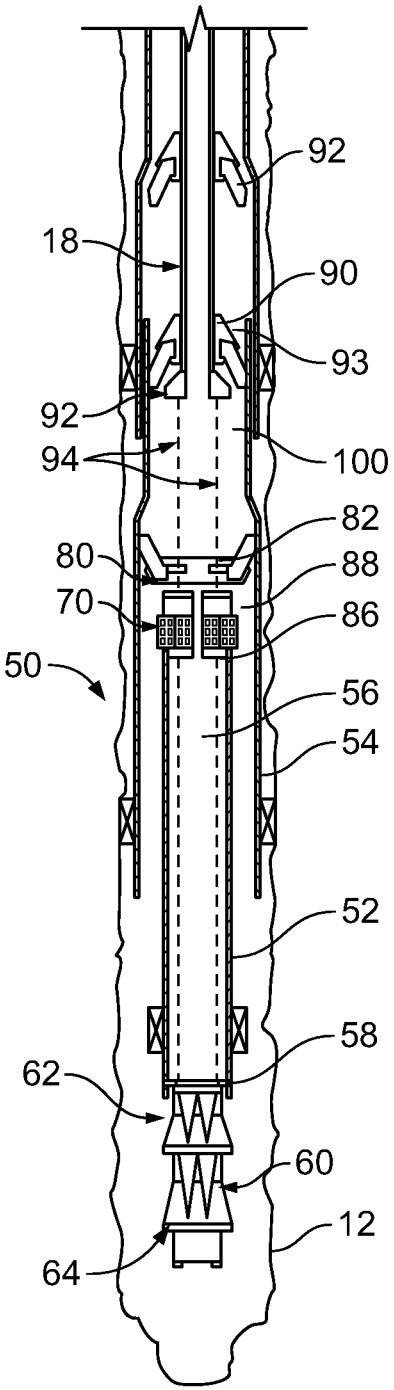
FIG. 2 illustrates a liner system in accordance with one embodiment of the present disclosure positioned in the wellbore.

Referring now to FIG. 2, there is shown one embodiment of a liner system 50 that may be used to connect a liner 52 to a parent liner 54. The liner system 50 may include an expander 60 for expanding the liner 52, an anchor 70 that selectively anchors the liner 52 to the parent liner 54, and a lower sealing member 80 and an upper sealing member 90 that form a pressure chamber 100 external to the liner 52. The upper and lower sealing members 80, 90 are both positioned in the wellbore 12 as opposed to at the surface (which may be a seabed). Thus, unlike surface or seabed equipment such as wellheads, subsea wellheads, risers, and blowout preventers, the sealing members 80, 90 are dimensioned and shaped to be conveyed along the wellbore 12 using the work string 18.

Figure 3:
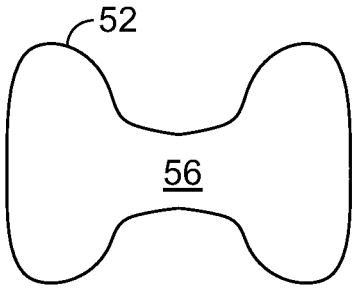
FIG. 3 illustrates a folded liner in accordance with one embodiment of the present disclosure.

Referring now to FIG. 3, the liner 52 may be formed as an expandable tubular having a dipole folded geometry. The liner 52 may have a non-circular non-expanded geometry that has a smaller effective diameter than when the liner 52 has been fully expanded. The liner 52 may be expanded by pulling the expander 60 (FIG. 2) through the passage 56. In one embodiment, the liner 52 is unfolded from an initial non-circular shape to an intermediate circular shape and then expanded to a circular shape of a larger diameter. In another embodiment, the liner 52 has an initial circular shape and is expanded to a greater diameter.

The work string 18 may be configured to pull the expander 60 through the passage 56. In one embodiment, the work string 18 may include a coupling 92 that connects one or more connectors 94 to the expander 60. For convenience, coiled tubing will be used as an exemplary work string, but it should be understood that any rigid or non-rigid member may be also used as a work string.

The connectors 94 may be bars, tubes, rods or other similar elongated members that connect the expander 60 to the work string 18. The connectors 94 may be configured to reside within the passage 56 and to transmit at least tension forces in the work string 18 to the expander 60. The connectors 94 may be rigid (e.g., steel rods) or non-rigid (e.g., steel cables). While two connectors 94 are shown, it should be understood that greater or fewer number of connector members may be used.

The upper sealing member 90 may be attached to the work string 18 and configured to selectively form a fluid barrier across an annular space 93 between the work string 18 and an inner diameter of the parent liner(s) 54. While two upper sealing members 90 are shown, it should be understood that fewer or greater number of sealing members may be serially distributed along the work string 18.

The lower sealing member 80 selectively forms a fluid barrier that prevents fluid pressure in the bore 82 from increasing fluid pressure inside the liner 52. Thus, the lower sealing member 80 hydraulically isolates the interior of the liner 52 from pressure uphole of the lower sealing member 80. The lower sealing member 80 may include one or more dynamic seals 84 that allow the connector(s) 94 to slide axially while maintain a sealing barrier across the bore 82. In some embodiments, the dynamic seals 84 may be structurally and functionally independent of the lower sealing member 80. The lower sealing member 80 may further include a port 86 that allows fluid communication between a bore 56 of the liner 52 and the annular space 88.

The sealing members 80, 90 may include a cup-shaped pliable sealing element that has direction-sensitive sealing functionality (e.g., swab cups). That is, the sealing elements may be canted to allow a seal to form when pressure is increased in either downhole or uphole location. In one arrangement, the upper sealing member 92 may have sealing element canted downward so that a downhole pressure increase activates the sealing function. The lower sealing member 92 may have sealing element canted upward so that an uphole pressure increase activates the sealing function. Thus, the opposing canted sealing elements of the sealing members 80, 90 cooperate to form a sealed environment for the pressure chamber 100, which is between the sealing members 80, 90.

In such arrangements, the upper sealing member 92 is deactivated when conveyed uphole and the lower sealing member 92 is deactivated when conveyed downhole. By deactivated, it is meant that fluid flow is permitted across the sealing members 80, 90. As discussed below, bypasses and valves may be used to reduce surge and/or swab effects when the upper sealing member 92 is conveyed downhole and the lower sealing member 92 is conveyed uphole.

The anchor 70 is fixed to an upper end of the liner 52 and selectively connects the liner 52 to the parent liner 54. As discussed above, the sealing members 80, 90 form fluid tight barriers that define a pressure chamber 100. When the pressure in the pressure chamber 100 reaches a predetermined value, the anchor 70 extends into an anchoring engagement with the liner 54. The pressure chamber 100 may be pressurized using fluids pumped from the surface by a pump 22 (FIG. 1) via the work string 18. Thus, the anchor 70 is activated/actuated using a pressure in the pressure chamber 100. Non-limiting devices suitable for the anchor 70 include radially extendable slips, pads, and arms.

The expander 60 may be a swage-type device that is coupled to a lower end of the connectors 94 and has a diameter or diameters selected to expand the liner 52 to a desired diameter. In one embodiment, the expander 60 may include an upper cone 62 and a lower cone 64. The cones 62, 64 may be formed of rigid materials. A locking member 58 may be used to connect the expander 60 to a lower end of the liner 52. The locking member 58 may be a shear pin or other device that is calibrated to decouple the expander 60 from the liner 52 upon a preset condition (e.g., a selected tension force). Also, one or both of the cones 62, 64 may be collapsible. That is, in an umbrella-type of fashion, the cones 62, 64 may be fixed in an enlarged configuration during the expansion process. Thereafter, a device such as a shear pin or locking mechanism may be activated (e.g., snapped or broken) to allow the cones 62, 64 to collapse into a dimensionally smaller configuration.

Figure 4:
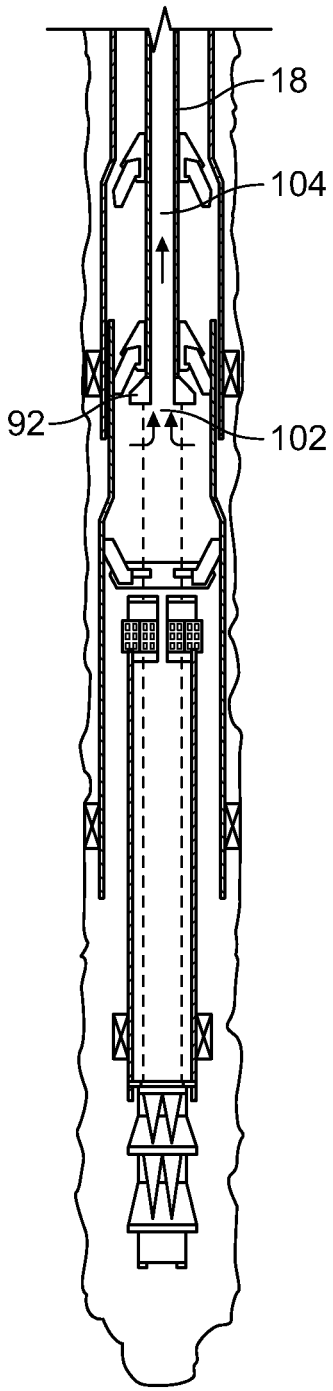
FIG. 4 illustrates a liner system in accordance with one embodiment of the present disclosure being run into the wellbore.

Referring now to FIGS. 4-15, the use of the liner system 50 to line a wellbore 12 will be described. In FIG. 4, the system 50 is being shown after being "run in" the wellbore 12. Typically, the wellbore 12 is filled with liquids. Therefore, the fluids below the liner system 50 may encounter a surge as the liner system 50 traverses the wellbore 12. Since the lower sealing member 80 is being conveyed downhole, the sealing function is deactivated due to the upwardly canted sealing member. Thus, fluids downhole of the liner system 50 flow to the opening 102 and to a bore 104 of the work string 18 at the coupling 92 and thereby reduce surge effects.

Figure 5:
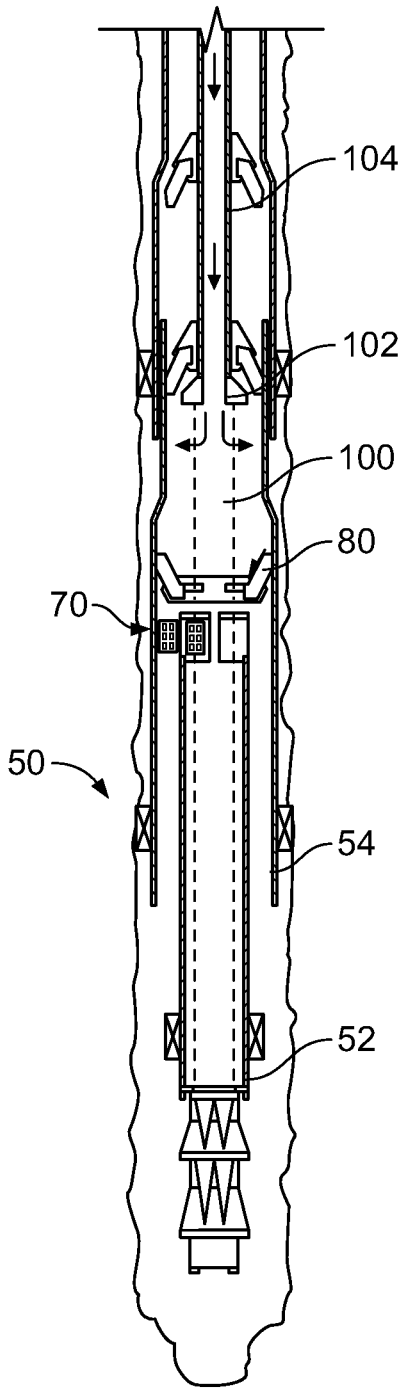
FIG. 5 illustrates a pressure chamber in accordance with one embodiment of the present disclosure being activated by fluid pumped down from the surface.

Referring now to FIG. 5, the liner system 50 is shown positioned at a distal end of the parent liner 54. Fluid pumped downhole via the bore 104 exits at the opening 102 and flows into the pressure chamber 100. Once the pressure in the pressure chamber 100 reaches a preset value, the lower sealing member 80 moves and engages the anchor 70. In response, the anchor 70 expands and anchors the liner 52 with the parent liner 54. It should be understood that other activation arrangements using a pressure in the pressure chamber 100 may be used to energize and activate the anchor 70. For example, the pressure in the pressure chamber 100 may be used by a piston cylinder system to engage ramps or sliding elements that drive anchoring elements of the anchor 52 radially outward into engagement with the parent liner 54.

Figure 6:
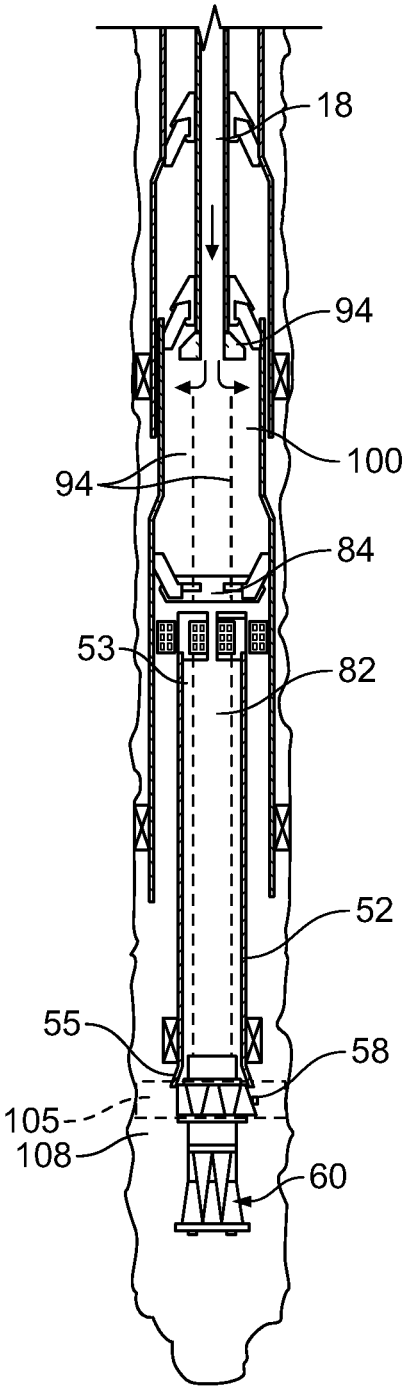
FIG. 6 illustrates an expander in accordance with one embodiment of the present disclosure being pulled into a liner.

Referring now to FIG. 6, as more fluid is pumped into the pressure chamber 100, the increased pressure applied to the upper sealing member 90 drives the work string 18 in an uphole direction. Thus, the upper and lower sealing members 90, 80 axially separate because the lower sealing member 80 is stationary and the upper sealing member 90 moves uphole. Because the expander 60 is fixedly connected to the work string 18 by the connectors 94, the expander 60 is also pulled in the uphole direction and into the liner 52. Once the tension force is sufficient to fracture or break the locking member 68, the expander 60 enters and expands the liner 52. In embodiments where the expander 60 includes a first cone 62 and a second cone 64, the first cone 62 may expand the liner 52 to a first diameter and the second cone 64 may expand the liner 52 to a larger second diameter.

The axial travel of the expander 60 through the liner 52 may induce axial loading on the liner 52. These loadings may be controlled by selectively anchoring the upper end 53 and the lower end 55 of the liner 52 during expansion. As shown in FIG. 6, the lower end 55 is not anchored to the wellbore wall 108 and the upper end 53 is anchored to the parent liner 54. Thus, upward axial travel of the expander 60 may cause a compressive loading in the liner 52, which may lead to buckling. In one variant, the lower end 53 of the liner 52 may be anchored to the wellbore wall 108 before the expander 60 using a suitable anchor 105. The anchor 105 may be any device that includes pads, ribs, slips, spikes, or other suitable anchoring elements that extend radially outward and engage the wellbore wall 108. The driver or actuator (not shown) for driving the anchoring elements into the wellbore wall 108 may be energized by pressurized fluids, electrical power, any other power source, which may be positioned at the surface or downhole. The anchor 105 takes up the axial loading during expansion and thus reduces the likelihood of buckling. It should be appreciated that the liner 52 may be expanded while under compression or tension while the anchor 105 is activated. To expand the liner 52 under compression, the anchor 70 may activated and engaged as shown in FIG. 6. To expand the liner 52 under tension, the anchor 70 may de-activated to release the upper end 53. It should be understood, tension and compression may be present the liner 52 in either situation (e.g., during compression, the section of the liner 52 downhole of the anchor 70 may be in tension). Thus, the tension or compression as referred to above is a predominant condition, as opposed to the only condition.

Generally, during the expansion of the liner 52, it should be appreciated that the pressure in the pressure chamber 100 is not communicated to the inner bore of the liner 52. Rather the dynamic seals 84 maintain a sealing barrier across the bore 82 while the connector(s) 94 to slide or translate axially upward. The pressure isolation of the bore 82 is maintained throughout the expansion process.

Figure 7:
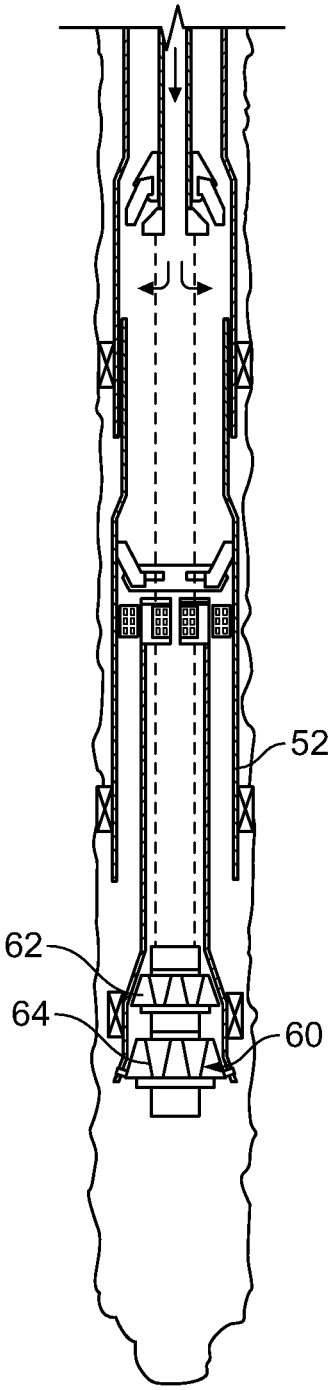
FIG. 7 illustrates the expander in accordance with one embodiment of the present disclosure expanding the liner.
Figure 8:
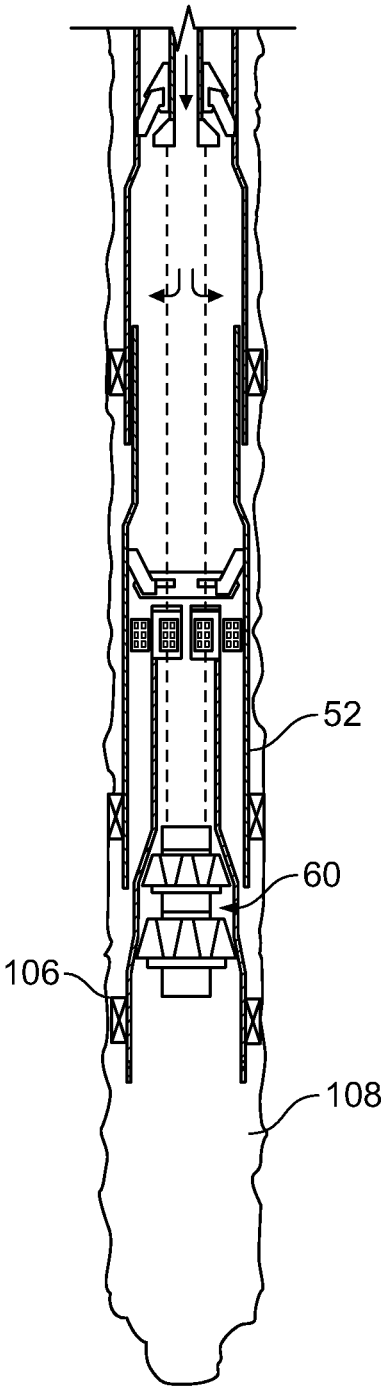
FIG. 8 illustrates the expander in accordance with one embodiment of the present disclosure expanding a liner shoe into engagement with a wellbore wall.

Referring now to FIG. 7, the first cone 62 and the second cone 64 of the expander 60 are shown travelling axially through the liner 52 and incrementally expanding the liner 52 to a first diameter, and then to a second larger diameter. Referring now to FIG. 8, a liner shoe 106 of the liner 52 is shown expanded and sealed with a wellbore wall 108 by the expander 60.

Figure 9:
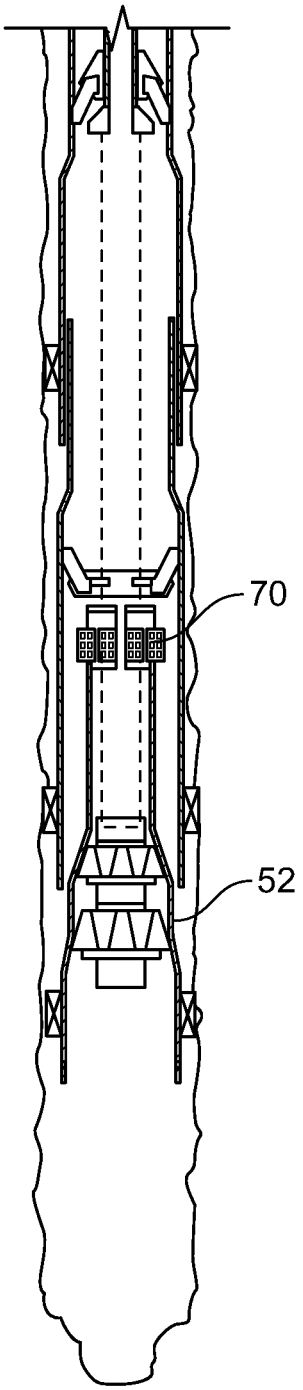
FIG. 9 illustrates an anchor in accordance with one embodiment of the present disclosure being deactivated to reduce a tension in the expanded liner.

Referring now to FIG. 9, there is shown a step that may be taken to reduce the tension in the liner 52. Generally, expanding a diameter of the liner 52 will cause a reduction in the length of the liner 52. During the FIG. 8 step, the liner 52 is fixed at both ends. Thus, the partially expanded liner 52 is in tension. To reduce the tension, the anchor 70 may be released, as shown, and thereafter reset.

In one variant, the liner 52 may be configured to be installed with a pre-tension value that is selected relative to a predicted expansion caused by applied in situ thermal energy. For instance, for geothermal wells, the liner 52 may be expected to lengthen due to thermal expansion. For such situations, the liner 52 may be expanded continuously and anchored into place. A suitable liner for such situations may include either an open hole packer at the expandable liner shoe or another anchoring device that anchors the liner shoe into the open hole. Therefore, the liner may be expanded in a fixed-fixed end condition that prevents axial shortening. With this arrangement, the pretension caused by expansion remains after the liner and parent liner are fixed in the wellbore. As the liner heats up to wellbore temperatures, the pretension is reduced to near neutral due to thermal expansion.

In conventional geothermal applications, casing is fully cemented to surface to fully support the casing and reduce the risk of compressive buckling during heat up. The fixed-fixed end variant described above may remove the need for a full cement sheath, and possibly the requirement for cement at all.

Figure 10:
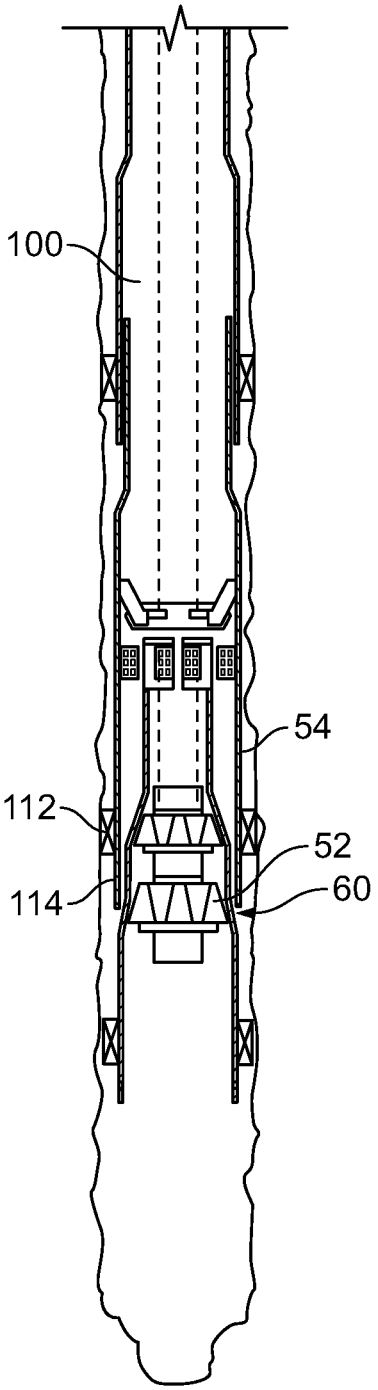
FIG. 10 illustrates the expander in accordance with one embodiment of the present disclosure entering an overlapping region of the liner and a parent liner.
Figure 11:
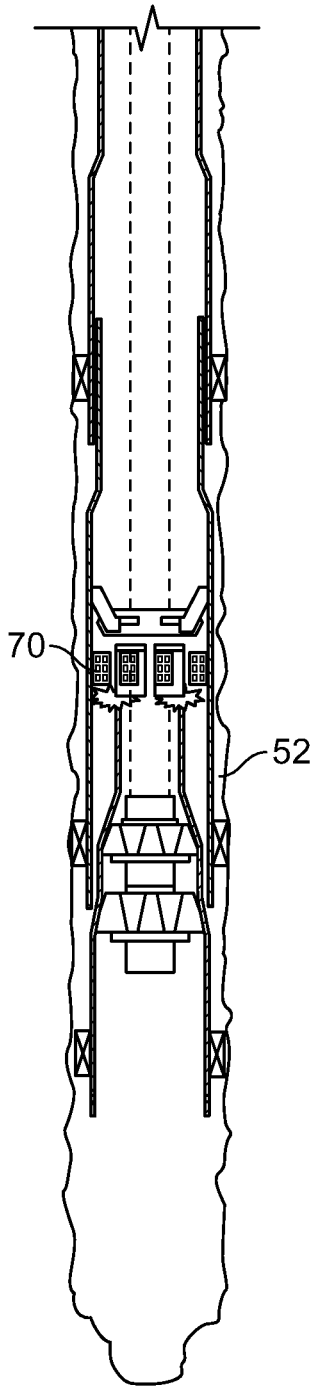
FIG. 11 illustrates the anchor in accordance with one embodiment of the present disclosure being disconnected from the liner.

Referring now to FIG. 10, the expander 60 is shown entering a region 112 where the liners 52, 54 overlap. When the expander 60 reaches a shoe 114 of the parent liner 54, the axial movement of the expander 60 is impeded. Because the pressure chamber 100 can no longer expand as fluid is pumped in, the pressure spikes. As shown in FIG. 11, once the pressure increases in the pressure chamber 100 to a preset value, a decoupling device (not shown) activates and allows the anchor 70 to separate from the liner 52. Suitable pressure-activated decoupling devices may be used to separate the anchor 70 from the liner 52.

Figure 12:
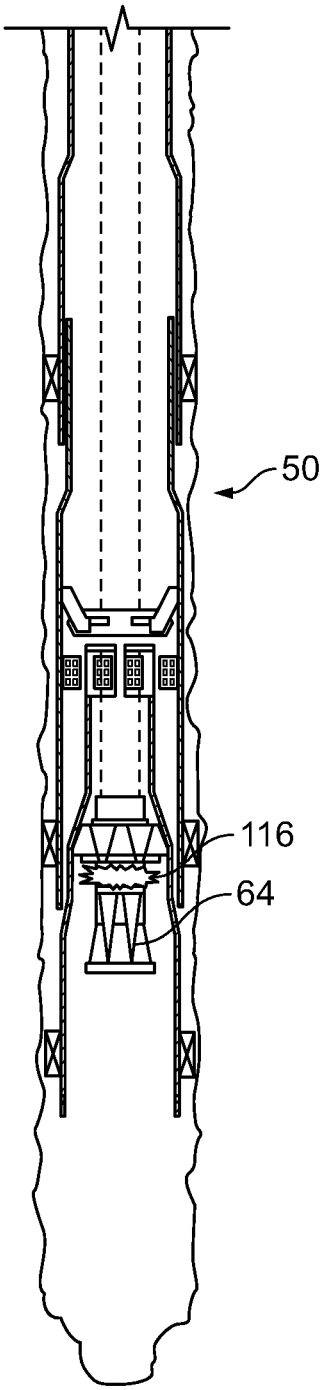
FIG. 12 illustrates the expander in accordance with one embodiment of the present disclosure being collapsed into a reduced diameter configuration.

Referring now to FIG. 12, a combination of increased pressure by pumping fluid and "overpull" (pulling up on the work string 18) are applied to the liner assembly 50. These tension forces activate a retraction device 116 in the expander 60 that allows the lower cone 64 to retract. For example, a shear pin (not shown) may be calibrated or configured to fracture and allow the lower cone 64 to collapse upon encountered a preset force (e.g., tension force).

Figure 13:
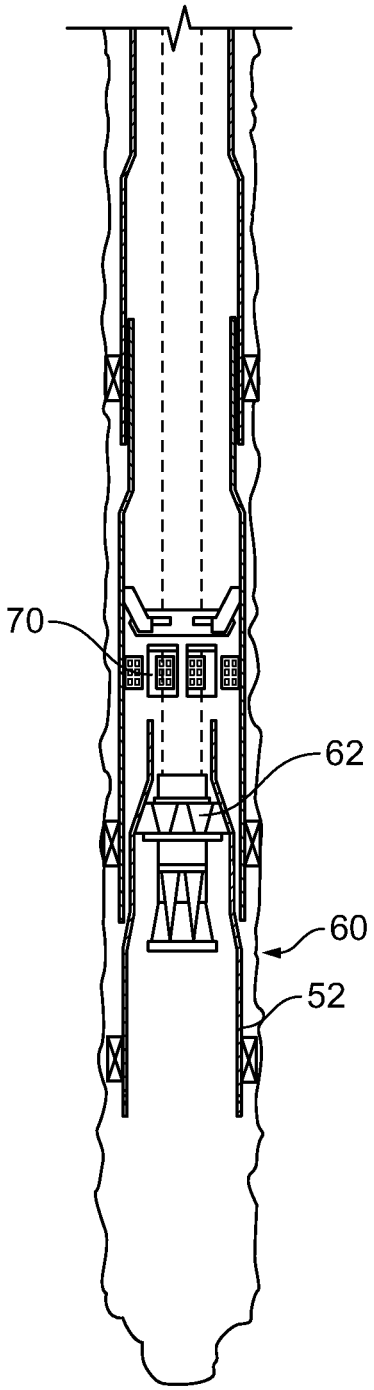
FIG. 13 illustrates the expander in accordance with one embodiment of the present disclosure continuing to travel through and expand the liner.
Figure 14:
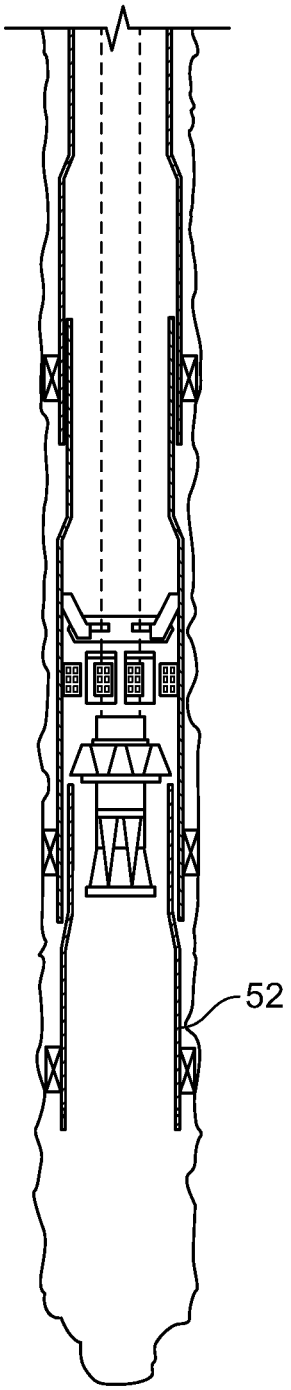
FIG. 14 illustrates a fully expanded liner.

Referring now to FIG. 13, the upper cone 62 of the expander 60 continues to expand the liner 52. It should be noted that the upper end of the liner 52 separates axially from the anchor 70 due to the shortening that occurs during expansion. FIG. 14 shows the liner 52 fully expanded.

Figure 15:
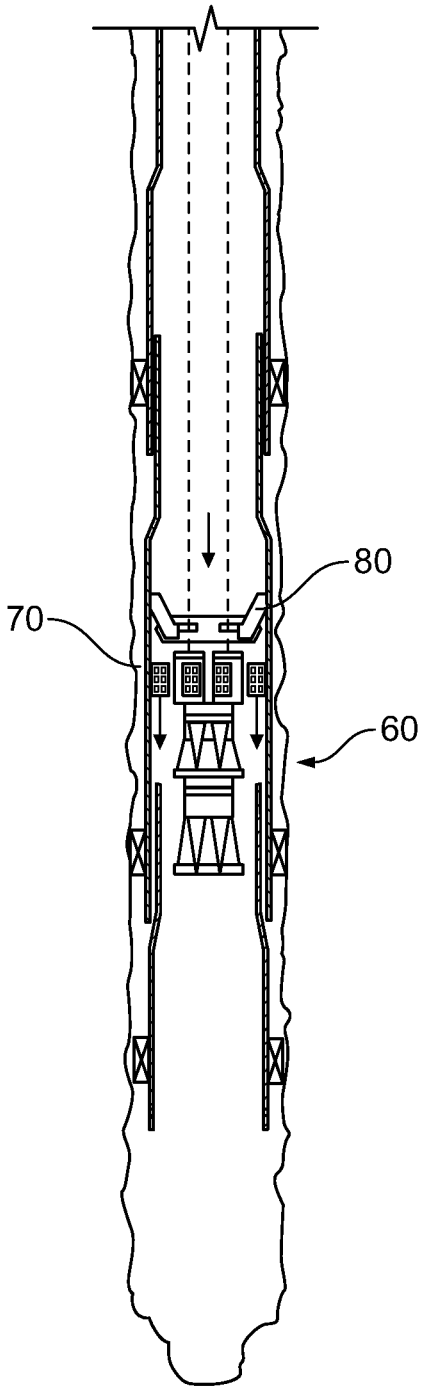
FIG. 15 illustrates a bypass allowing fluid flow across the liner assembly while the liner assembly is conveyed out of the well.

Referring now to FIG. 15, the expander 60 is shown engaging the anchor 70 and the lower sealing member 80. This engagement activates a bypass (not shown) in the lower sealing member 80 that allows fluid communication across the lower sealing member 80. Thus, when the liner system 50 is pulled out of the wellbore 12, the fluid uphole of the lower sealing member 80 can flow across and downhole of the lower sealing member 80.

The term "work string" as used herein means any device, device component, combination of devices, media and/or member that may be used to convey, house, support or otherwise facilitate the use of another device, device component, combination of devices, media and/or member. Exemplary non-limiting work strings include drill strings of the coiled tube type, of the jointed pipe type and any combination or portion thereof. Other carrier examples include casing pipes, downhole subs.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A method of lining a wellbore, comprising:

placing a first liner in the wellbore, the first liner having a lower section;

placing a second liner in the wellbore, with an upper section of the second liner placed inside the lower section of the first liner;

positioning an upper sealing member and a lower sealing member in the wellbore to form a pressure chamber, wherein the upper sealing member and the lower sealing member move axially away from one another, the axial movement causing the work string to move upward and pull the expander through a bore of the second liner;

expanding the second liner using the pressure chamber; and positioning the upper and the lower sealing members in the first liner and above the second liner, thereby hydraulically isolating an inner bore of the second liner from the pressure chamber.

2. The method of claim 1, further comprising anchoring the second liner to the first liner using an anchor.

3. The method of claim 2, further comprising activating the anchor using the pressure chamber.

4. The method of claim 1, wherein the expanding is done using an expander connected via at least one connector to a work string.

5. The method of claim 4, further comprising fixing the upper sealing member to the work string.

6. The method of claim 4, further comprising forming a fluid seal using at least a dynamic seal to hydraulically isolate the inner bore of the second liner.

7. The method of claim 4, further comprising conveying the upper sealing member and the lower sealing member into the wellbore using the work string.

8. The method of claim 4, further comprising pumping a fluid down the work string to pressurize the pressure chamber.

9. The method of claim 1, further comprising:

fixing the ends of the second liner during expansion to cause a selected pretension; and fixing the second liner in the wellbore with the selected pretension.

10. A method of lining a wellbore, comprising:

placing a first liner in the wellbore, the first liner having a lower section;

placing a second liner in the wellbore, with an upper section of the second liner placed inside the lower section of the first liner;

positioning an upper sealing member and a lower sealing member in the wellbore to form a pressure chamber;

pumping a fluid down the work string to pressurize the pressure chamber; and expanding the second liner using the pressure chamber, wherein the upper sealing member and the lower sealing member move axially away from one another, the axial movement causing the work string to move upward and pull the expander through a bore of the second liner, and wherein the expanding is done using an expander connected via at least one connector to a work string.

11. The method of claim 10, further comprising anchoring the second liner to the first liner using an anchor, and activating the anchor using the pressure chamber.

12. The method of claim 10, further comprising fixing the upper sealing member to the work string.

13. The method of claim 10, further comprising forming a fluid seal using at least a dynamic seal to hydraulically isolate the inner bore of the second liner.

14. An apparatus for positioning a first liner and a second liner in a wellbore, the second liner having an upper section placed inside a lower section of the first liner, the apparatus comprising:

at least one upper sealing member;

at least one lower sealing member cooperating with the at least one upper sealing member to form a pressure chamber that is hydraulically isolated from an inner bore of the second liner, wherein the at least one upper sealing member and the at least one lower sealing member are positioned in the first liner and above the second liner, and wherein the at least one upper sealing member and the at least one lower sealing member are configured to axially separate in response to a pressure in the pressure chamber;

a work string configured to convey the at least one upper sealing member and the at least one lower sealing member into the wellbore, and wherein the axial separation causes the work string to move upward and pull the expander through a bore of the second liner;

at least one connector connected to the work string and extending through the pressure chamber and the second liner; and an expander connected to the connector, the expander being configured to expand the second liner in response to the axial separation of the at least one upper sealing member and the at least one lower sealing member.

15. The apparatus of claim 14, further comprising an anchor configured to selectively anchor the second liner to the first liner, the anchor being activated using the pressure chamber.

16. The apparatus of claim 15, wherein the anchor including a decoupling device configured to decouple the anchor from the first liner, the decoupling device being activated using the pressure chamber.

17. The apparatus of claim 14, wherein at least a portion of the pressure chamber is formed inside a bore of the first liner.

18. The apparatus of claim 14, wherein the work string is configured to flow fluid into the pressure chamber.

19. The apparatus of claim 14, wherein the at least one upper sealing member is fixed to the work string.

20. The apparatus of claim 14, further comprising a dynamic seal surrounding the at least one connector and configured to allow axial movement of the at least one connector while maintaining a seal.

* * * * *